United States Patent [19]

Chi-Cheng

[11] Patent Number: 4,956,984

[45] Date of Patent: Sep. 18, 1990

[54] LOCKING DEVICE

[76] Inventor: Lo Chi-Cheng, 8, Alley 158, Sec. 4, Nanking East Rd., Taipei, Taiwan

[21] Appl. No.: 280,389

[22] Filed: Dec. 6, 1988

[51] Int. Cl.[5] ..... E05B 47/00

[52] U.S. Cl. ..... 70/277; 70/279; 70/413

[58] Field of Search ..... 70/277, 278, 279, 285, 70/413; 340/825.3, 825.31

[56] References Cited

U.S. PATENT DOCUMENTS

| | | | |
|---|---|---|---|
| 3,234,516 | 2/1966 | Miller | 70/278 X |
| 4,665,727 | 5/1987 | Uyeda | 70/279 |
| 4,676,083 | 6/1987 | Sedley et al. | 70/277 X |

FOREIGN PATENT DOCUMENTS

| | | | |
|---|---|---|---|
| 2182975 | 5/1987 | United Kingdom | 70/278 |

*Primary Examiner*—Robert L. Wolfe
*Assistant Examiner*—Suzanne L. Dino
*Attorney, Agent, or Firm*—Asian Pacific Int'l Patent & Trademark Office

[57] ABSTRACT

A dual locking latches locking device uses an electronic system or mechanical transmission system to respectively control its own open and close motions. Its dual latches are controlled respectively by two clutch transmission mechanisms. When a user inserts a correct magnetic card in the card reader, its first clutch transmission mechanism is in engagement. When a user inputs a correct code via the keyboard or uses a correct key to unlock it, the second clutch transmission mechanism is all in engagement. At this moment, the user turns the external or internal button and handle at the same time, the lock can be unlocked right away.

6 Claims, 8 Drawing Sheets

LOCKING DEVICE

BACKGROUND OF THE INVENTION

This invention relates to a locking device having dual locking latches that are open and closed by electronic system or mechanical structure.

Traditional locking devices can be classified into two categories: machine-transmission mechanical locks and electronic-controlled lock. Mechanical locks are firm and strong, and cheap, but must be unlocked by carrying thick and heavy metal keys. If the keys are forgotten or lost, the unlocking operation can not be completed easily, which is considerably inconvenient. The electronic locks may be unlocked by using codes, magnetic cards or remote controllers, and so on, which avoids the lost key problem. Besides, the used unlocking codes or cards can be changed by some modifications of the programs. They are particularly suited to hotels, and rented apartments where the residents circulation is high. However, the electronic locks are not so firm and strong as mechanical ones, easily subjected to destruction by violence, and, what's more, are expensive. When they are used, their electricity consumption is large. If the electric power of the battery is not enough or the electric power supply is cut off, the unlocking operation cannot be finished conveniently.

Accordingly, it follows that we still need a locking device with both good points of a mechanical lock and electronic lock while without the drawbacks of them.

SUMMARY OF THE INVENTION

The objective of this invention is to provide a dual system locking device, which can use a mechanical lock in case the electronic system is out of order or the electric power supply is cut off or ineffective.

Another objective of this invention is to provide the above locking device with dual locking latches, both of which must be unlatched to unlock the door. The locking device is particularly suitable for computer rooms, classrooms, or other places where the control of exits and entrances is a must.

Another objective of this invention is to provide a locking device, all the members of which can be received within a small, but strong locking body. The drive means used to operate the locking latch is equipped with a clutch thereby preventing robbers from breaking in.

Another objective of this invention is to provide a locking device, whose power consumption is only 20%-30% of that of a traditional electronic lock. Therefore, the solar-silicon crystal battery or dry battery may be used to supply current without requiring connection to a household alternating current power supply. The arrangement avoids problems of layout and installation of electric lines.

Another objective of this invention is to provide the above locking device with the characteristics of easiness, safety, and durableness.

A locking device of the invention comprises a system of dual locking latches equipped with multiple drive clutches. As the caretaker takes a correct magnetic card and inserts it in a card reader, a voltage is produced in such a way that a first magnetic coil attracts the a first drive clutch to a position of engagement. Then, by turning an external button manually, the first locking latch can be unlocked right way. Many staff members or students may input a coded signal through a keyboard to a second magnetic coil to attract a second clutch drive to a position of engagement. Then, by operating an external handle manually, the second locking latch can be unlocked at once. When two locking latches are all unlocked, the door locked by this dual system locking device may be opened. This dual system locking device is useful in places where the control of entrances and exits is a necessity. In such places, ordinary staff members or students are allowed to get in and out during working time or educational time, but are restricted from getting in and out at other periods.

BRIEF DESCRIPTION OF THE DRAWING

The drawings disclose an illustrative embodiment of the present invention which serves to exemplify the various advantages and objects hereof, and are as follows.

DETAILED DESCRIPTION OF THE PREFERRED EMBODIMENT

Figure 1:
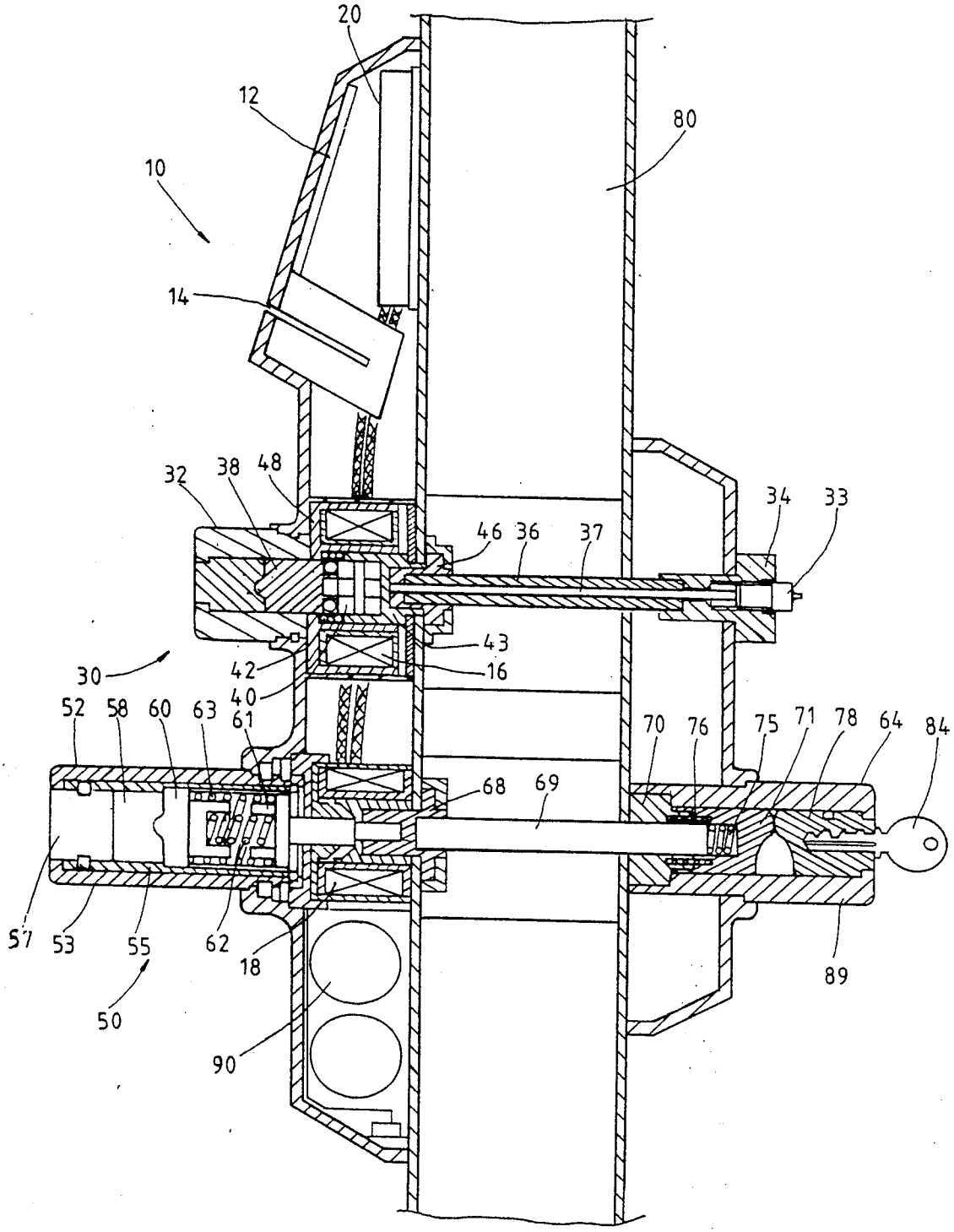
FIG. 1 is a longitudinal sectional view of the preferred embodiment of the locking device of dual system and dual locking latches, according to the present invention.
Figure 2:
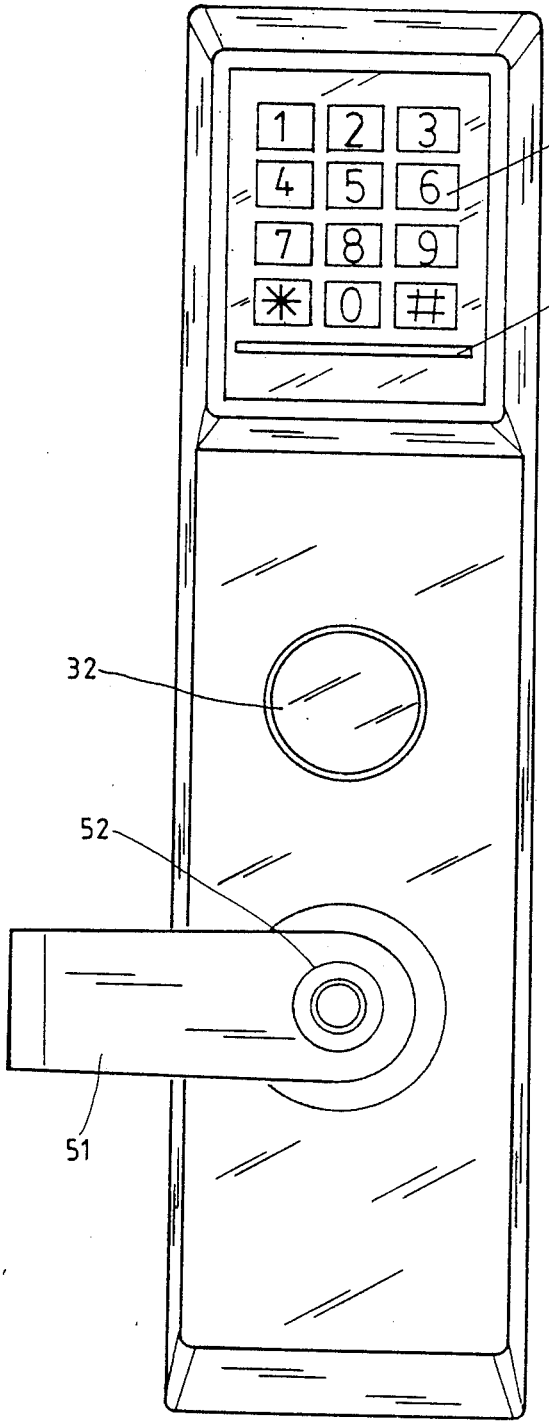
FIG. 2 is a front view of the above embodiment.
Figure 3:
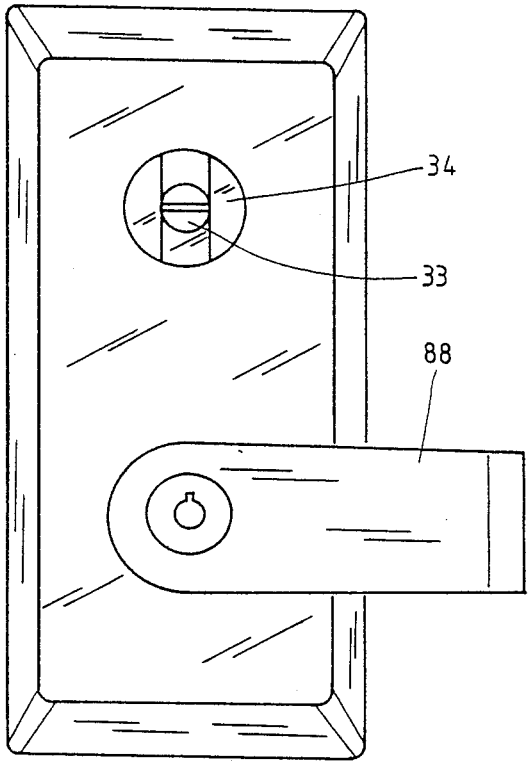
FIG. 3 illustrates the rear view of the above embodiment.

Please refer to the appended drawings to show a locking device 10 using two locking latches to lock door 80, which can be unlocked by using an electronic system or keys 82 and 84. The locking device 10 mainly includes two parts: an electronic system and a mechanical transmission system. The electronic system includes keyboard 12, card reader 14, the first and second magnetic coils 16 and 18 respectively controlled by the card reader 14 and keyboard 12, and the known control circuit 20. The mechanical transmission system mainly includes the first and second drive clutches 30 and 50. When those clutches are in temporary engagement, their two latches (not shown) can be driven by external handle 52 and button 32 to disengage the door latches to get the door 80 unlocked. However, when those clutches are disengaged the button and handle can only idle but fail to drive the door latches.

Figure 4:
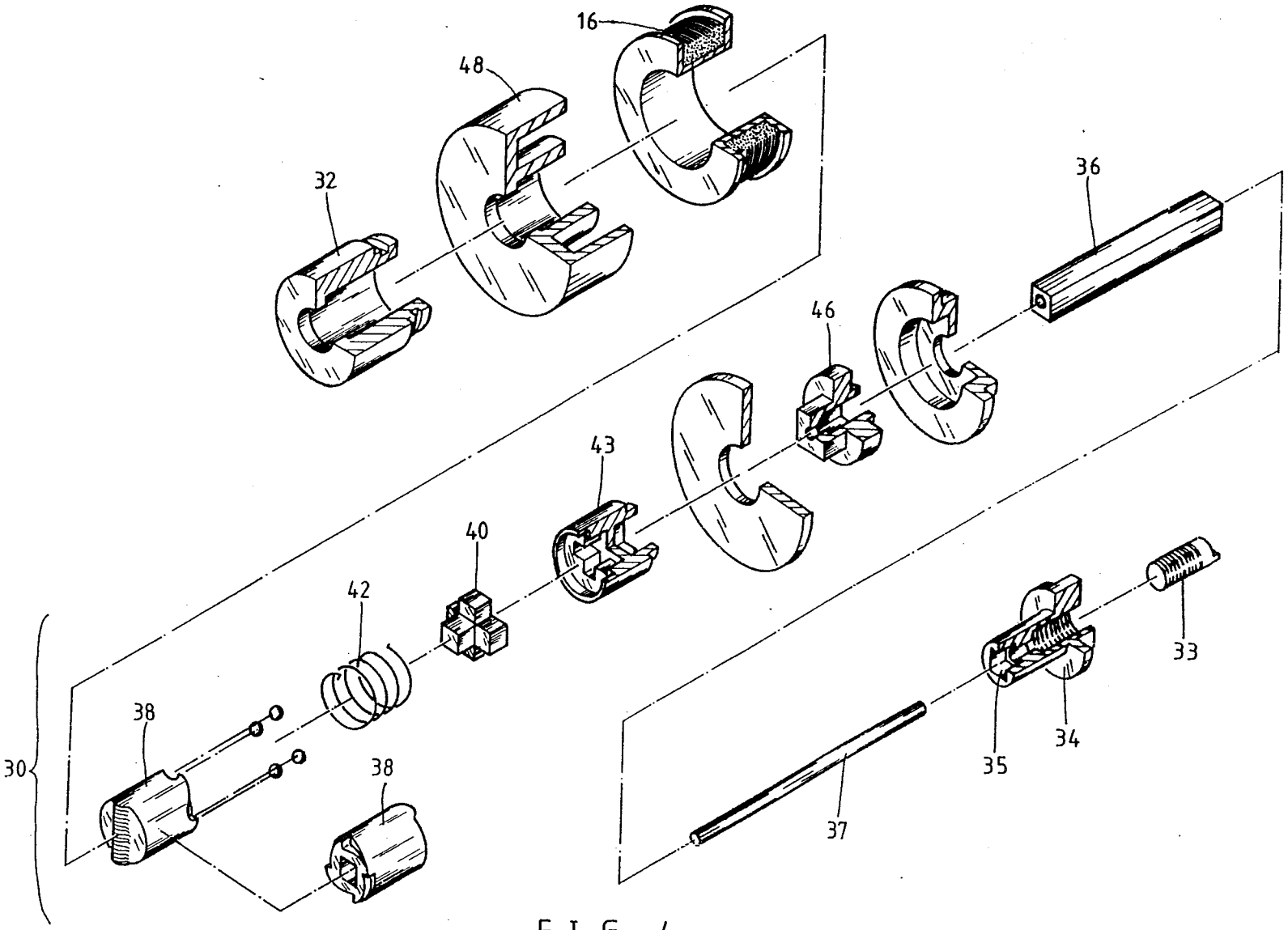
FIG. 4 is an exploded perspective view of a first clutch drive used in the FIG. 1 system.
Figure 6:
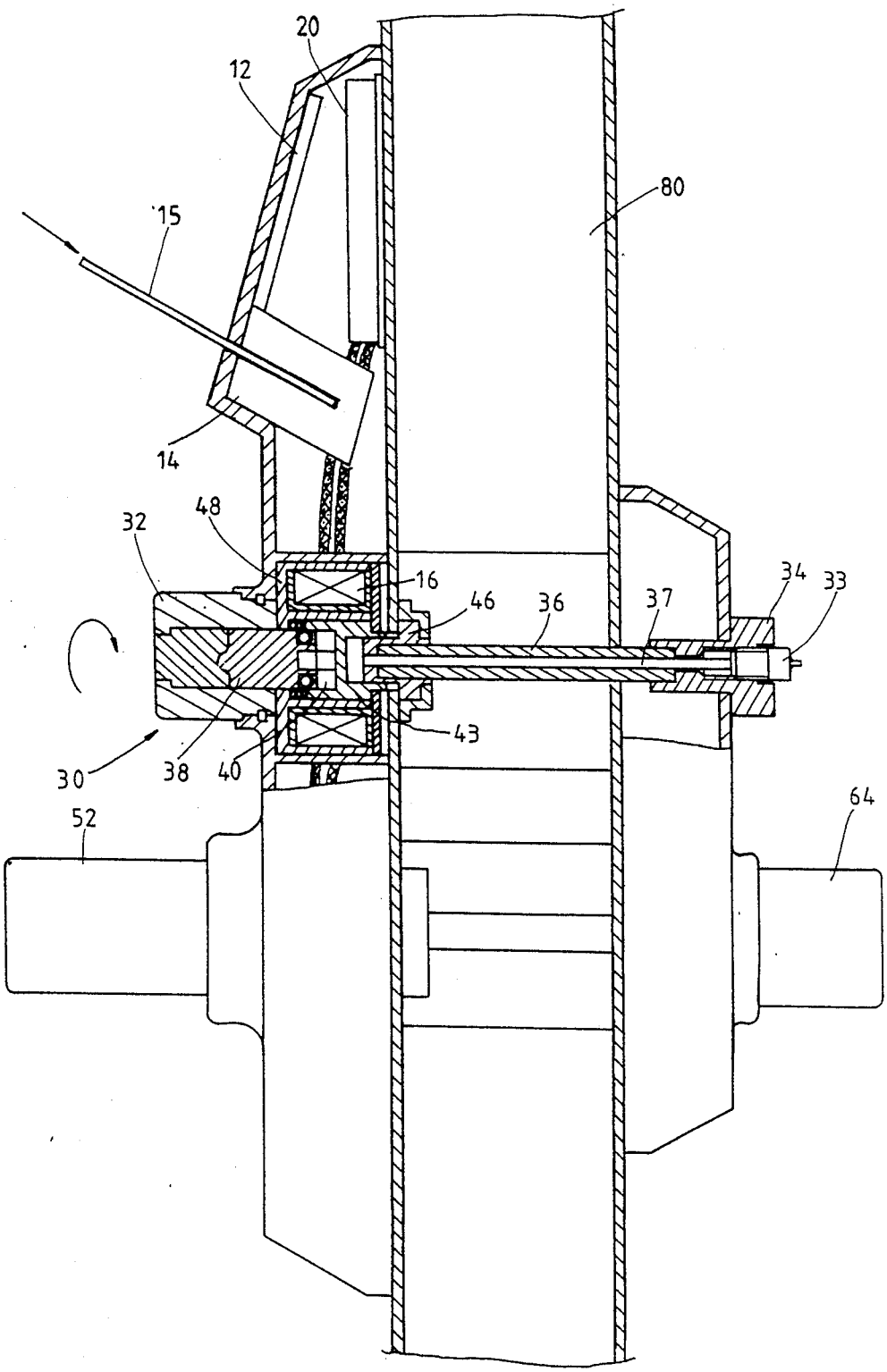
FIG. 6 illustrates the action of a magnetic card used to unlock the first locking latch in the same embodiment as above.

Please refer to FIG. 1 and FIG. 4 at the same time. The first clutch drive 30 includes exteral button 32 and internal button 34. The front end of the internal button 34 has a square hole 35 which can be embeded in the tail of the square latch operator bolt 36. Therefore, when the internal button 34 is turned from inside, the square bolt 36 can be directly driven. And, as the square bolt 36 is turned, the first locking latch (not shown) is made to reciprocate in a known way to lock or unlock the door 80. The external button 32 can only bring a one-way brake drive connection 38 and cross joint 40 to turn unidirectionally. The cross joint 40 is ordinarily separated from sliding drum 43 by a spring 42. In the meantime, the motive force cannot be transmitted to the sliding drum. That is, ordinarily the external button 32 can only idle but fail to drive square bolt 36. The sliding drum 43 can drive square bolt 36 through a connecting member 46. The sliding drum 43 is cased in circular seat 48. The circular seat 48 is a mounting structure for the first magnetic coil 16. As shown in FIG. 6, when a correct magnetic card 15 is inserted in the card reader 14 to make the first magnetic coil 16 electrified, the sliding drum 43 engages the cross joint 40; drum 43 acts as an armature. At this moment, when the user turns exteral button 32 from outside, the square bolt 36 can be driven to rotate. Yet, when the first magnetic coil 16 is not electrified, the sliding drum 43 is then pushed rightwardly by the spring 42 so that the disengagement related to it and the cross joint 40 is then restored. Thus, the cross joint 40 and sliding drum 43 constitute the first clutch which can be in temporary engagement or disengagement. When the clutch elements are in engagement, the outside user can turn external button 32 to unlock the first locking latch. However, when the clutch elements are in disengagement, the external button can only idle but fail to move the locking latch carried on bolt 36.

Figure 9:
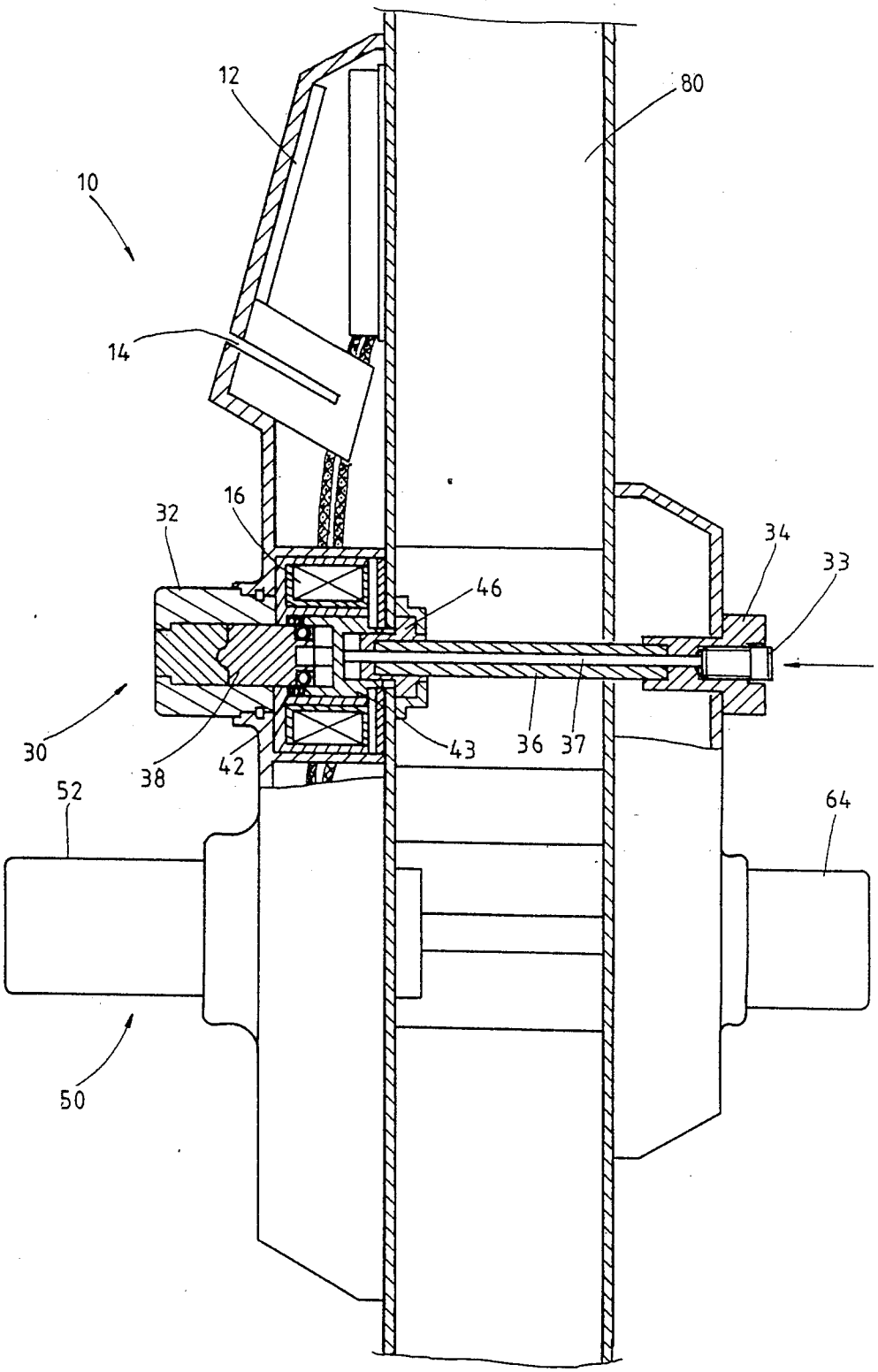

As shown in FIG. 9, the first clutch drive 30 further includes one screw arbor 33 turnable from inside, and a push rod 37 engaged with the sliding drum 43 to push drum 43 into engagement with the cross joint 40 in such a way that everybody can turn the external button 32 from outside to unlock the first locking latch. But when the screw arbor 33 is turned to the FIG. 1 position, the clutch 40 and 43 are restored to the state of disengagement again to make the external button only idle.

The first clutch drive 30 is violence-proof. Because the external button 32 is buttressed by the fixed circular seat 48, when the door breaker uses violence to hit the external button 32, his exerted force is held by the circular seat 48, and cannot break its internal member, or make mechanism 30 move incorrectly.

Figure 5:
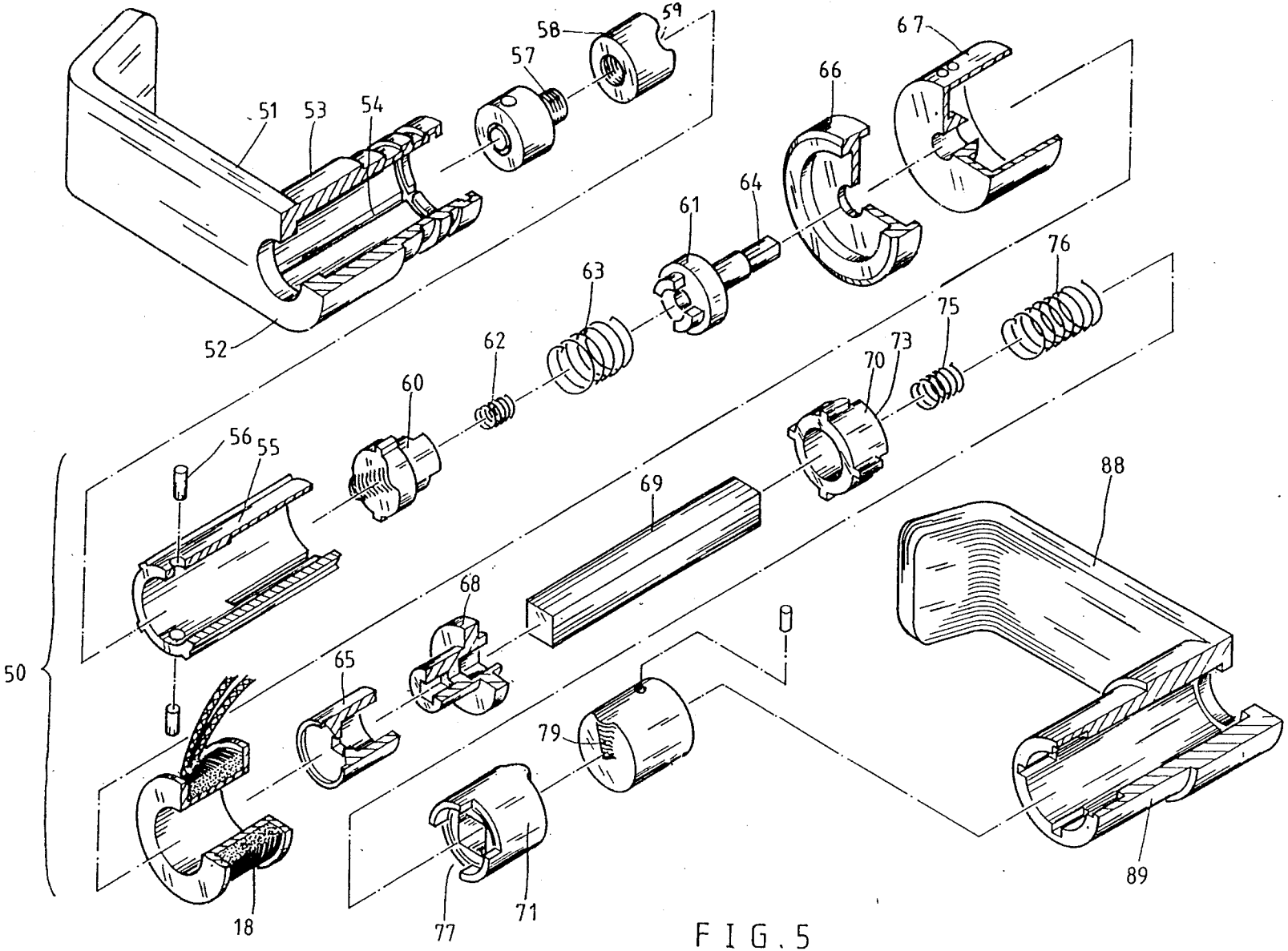
FIG. 5 is a exploded perspective view of a second clutch drive used in the FIG. 1 system.

Please refer to FIGS. 1 and 5 at the same time. The second clutch drive 50 includes an external handle 52 and internal handle 64. The external handle has a knob 51 and a drum part 53. The drum uses a groove 54 to embed a sleeve 55 in such a way that the drum part 53 and the sleeve 55 form rotating members in pairs. That is, when the drum part 53 is turned by the user, it causes the sleeve 55 to rotate. Nevertheless, when the drum part 53 is hit by the door robber using violence, the sleeve 55 doesn't move wrongly due to the violence. In the sleeve, there is a locking core 57 fixed by pins 56. The locking core 57 can be only rotated by using a correct key 82, and can drive a cylindrical cam 58 to rotate. Since the end face of the cam 58 has a groove 59, when it rotates, it can bring the first coupler clutch element 60 constituting a part of the second clutch to move back and forth intermittently. The first coupler 60 and the second coupler clutch element 61 constitute the second clutch, which is ordinarily subjected to the propulsive force from the springs 62 and 63 between both of them in such a way that the clutch is in disengagement. The tail end of the second coupler 61 forms a square member 64, which passes through a fixed cover 66, circular seat 67 and sleeve 65 to key into the connector 68. The connector 68 further engages with one end of the square latch bolt 69. When the square bolt 69 rotates, the second locking latch (not shown) is made to move intermittently in a known way to lock or unlock the door 80. The other end of the square bolt 69 passes through a drum (clutch element) 70, and then engages with a sliding clutch element 71. The drum 70 includes keys 72 that engage in slots in drum part 89 of the internal handle 88 so as to rotate following with the internal handle. The contact faces between the drum 70 and sliding member 71 have clutch fingers 73 and 77 constitute the third clutch. The third clutch 70 and 71 usually remain disengaged because of the propulsive force from the intermediate spring 75 and 76 between both of them. In the drum part 89 of the internal handle, there is a locking core 78 which is only rotated by the inserted correct key 84. The contact face between locking core 78 and the sliding member 71 has flanges 74 and 79 which coordinate with each other. Consequently, when the locking core rotates, it can drive the sliding member 71 to move back and forth intermittently and to engage or disengage with the drum 70.

Ordinarily, the clutch 60, 61, 70, and 71 all remain disegaged owing to the propulsive force from the springs to make the internal and external handles only idle but fail to bring the square bolt 69 to rotate.

Figure 7:
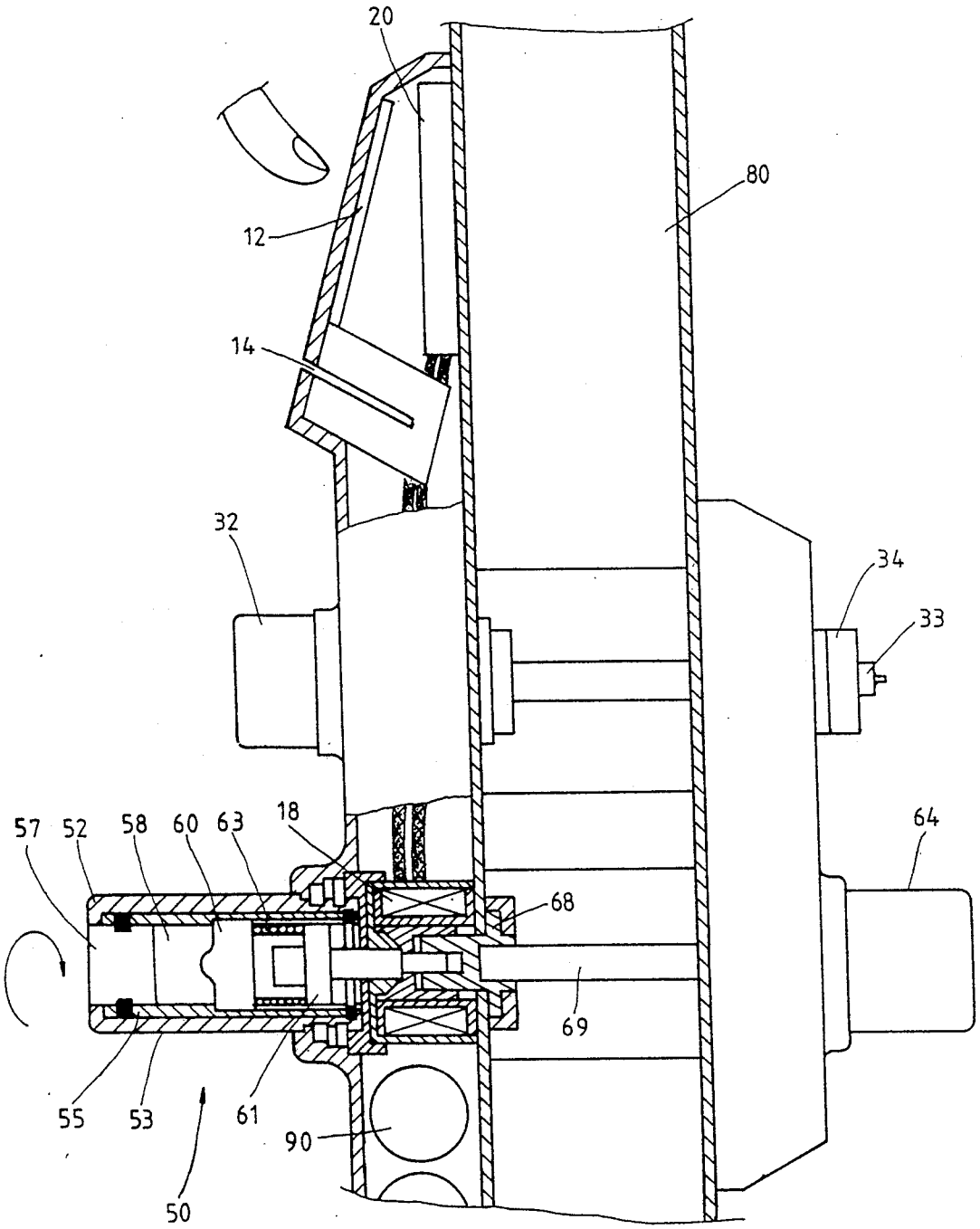
FIG. 7 illustrates the action of a second locking latch that is unlocked by hitting the keyboard in the same embodiment as above.
Figure 8:
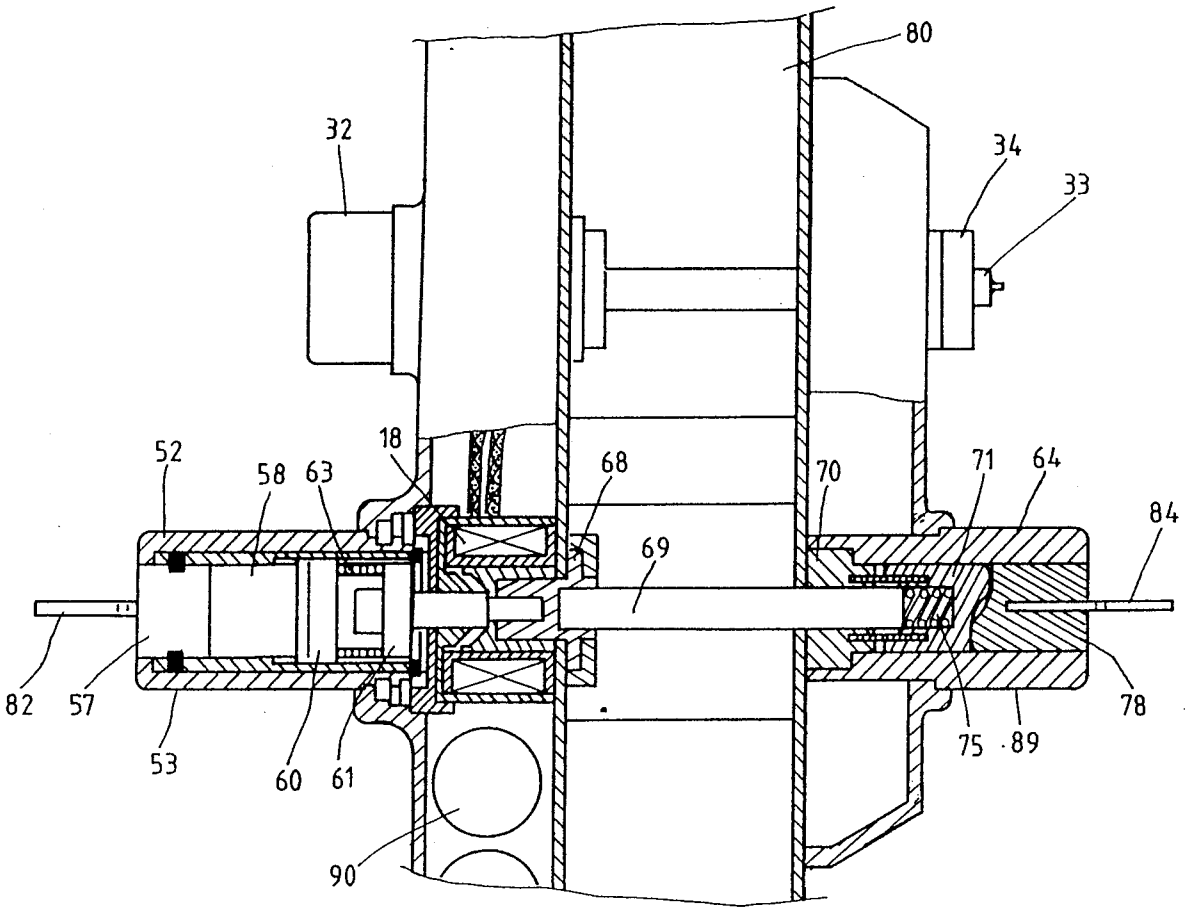
FIG. 8 illustrates the action of a second locking latch that is unlocked by using internal and external keys in the same embodiment as above. And, FIG. 9 illustrates the action of a screw arbor that is tightened to make the first clutch drive always remain in engagement in the same embodiment as above.

Please refer to FIG. 7 and 8. The clutch 60 and 61 of the external handles can be engaged by using a correct key 82 or magnetic coil 18. When the correct key 82 is inserted in the locking core 57 of the external handle and the locking core 57 is turned, the first coupler may be pushed to move by the cylindrical cam 58 to engage with the second coupler 61 in such a way to bring the square bolt 69 to rotate to unlock the second locking latch. Or, as shown in FIG. 7, the outside user may input the correct code via the keyboard 12 to conduct the power supply of the second magnetic coil 18 in such a way to produce an propulsive force against the second coupler 61 toward the first coupler 60 and make them engage with each other. Meanwhile, when the user turns the external handle 52, through the locking core 57, cylindrical cam 59, the first coupler and the second coupler 61, which move together, the motive force may be transmitted to the square bolt 69 thereby rotating to unlock the second locking latch.

Please refer to FIG. 1. The clutch 70 and 71 of the internal handle can be engaged together by using a correct key 84. When a correct key 84 is inserted in the locking core 78 of the internal handle to make the locking core 78 rotate, the sliding member 71 is pushed toward the drum 70 for engagement. In the meantime, when the inside user rotates the internal handle 88, the square bolt 69 can be rotated to unlock the second locking latch through the related drum 70 and the sliding member 71 which move together.

The locking device, constituted by the electronic system and the mechanical transmission mechanical system described above, can be ordinarily unlocked by using the electronic system. Only when the electronic system is out of order or the power supply comes short can the spare correct key 84 be used to unlock. Besides, the electronic system only electrifies the first and the second magnetic coils to make all the clutches keep in engagement. Then the user turns the external button and/or handle to unlock the locking latch by means of the transmission of the motive force from the mechanical transmission system. Thus, the power consumption is ony 20%–30% of that of the accustomed electronic lock. Due to the relatively low power consumption, a solar silicon crystal or four group battery in series 90 may be used to replace traditional home-use alternating electricity as the power supply needed by the electronic system thereby eliminating the drawback of difficult layout and installation of electric lines related to the accustomed electronic lock.

This invention provides the locking device with two locking latches, particularly suitable for the public or secret offices or educational places where the control of entrances and exits is necessary. After a caretaker takes a correct magnetic card and inserts same in a card reader, a voltage is produced which makes the first magnetic coil attract the first clutch drive to a position of engagement. Then he uses his hand to turn the external button, and therefore the first locking latch is unlocked. Many office staff or students input a correct code via a keyboard respectively to conduct the second magnetic coil power supply to attract the second clutch drive to a position of engagement. Then the external handle 52 is turned manually, and thus the second locking latch is unlocked. When both of the latches are all unlocked, the door locked by the dual system locking device is then unlocked. This dual system locking device has a worthy use for the places where the control of entrances and exits is necessary. In such places, general office staff or students are allowed to enter and get out during the working or educational time, but are restricted to enter and get out at other periods.

As indicated, the structure herein may be variously embodied. Recognizing various modifications will be apparent, the scope hereof shall be deemed to be defined by the claims as set forth below.

What is claimed is:

1. A door locking device comprising:

a card reader (14) adapted to receive a magnetic card to generate a first control signal; a first magnetic coil (16) operable by the first signal;

a push button keyboard (12) operable to generate a second control signal;

a second magnetic coil (18) operable by the second control signal;

a first rotary latch bolt (36), an external manual operating member (32), a first disengageable clutch means (40,43) operated by said first magnetic coil for transmitting a rotary drive force from said external operating member to one end of said first latch bolt, and an internal manual operating member (34) drivably connected to the other end of said first latch bolt independent of said external operating member;

a second rotary latch bolt (69), an external handle (52), a second disengageable clutch means (60, 61) operated by said second magnetic coil for transmitting a drive from said external handle to one end of said second latch bolt, key-operated means (58) in said external handle for operating said second clutch means independently of said second coil, and internal handle (88), and a second key-operated means (78,71) within said internal handle for transmitting a drive force from said internal handle to the other end of said second latch bolt.

2. The locking device of claim 1, and further comprising a manual push rod means (36) extending through said first latch bolt for operating said first clutch means independently of said first magnetic coil.

3. The locking device of claim 1, wherein said first clutch means comprises a slidable armature means (43) keyed to said first latch bolt within the space circumscribed by the first magnetic coil.

4. The locking device of claim 3, and further comprising a one-way drive connection between said first manual operating member and said first clutch means.

5. The locking device of claim 3, wherein said second clutch means comprises two axially movable clutch elements movable toward one another to achieve a drive connection; one of said clutch elements being slidably keyed to said external handle, and the other of said clutch elements being slidably keyed to said second latch bolt; said first key-operated means comprising a rotary cam means effective to apply an axial force to said one clutch element; and a second slidable armature means (65) within the space circumscribed by the second magnetic coil for applying an axial operating force to said other clutch element.

6. The locking device of claim 1, wherein said second key-operated means comprises a third clutch means and a rotary cam means effective to apply an axial operating force to said third clutch means.

* * * * *